United States Patent [19]

Moore, Jr.

[11] 4,015,460

[45] Apr. 5, 1977

[54] ROLLING MILL PLUG ASSEMBLY

[75] Inventor: Harry M. Moore, Jr., Beaver Falls, Pa.

[73] Assignee: Damascus Steel Casting Company, New Brighton, Pa.

[22] Filed: Jan. 9, 1976

[21] Appl. No.: 647,908

[52] U.S. Cl. ..... 72/97; 72/209

[51] Int. Cl.[2] ..... B21B 25/00

[58] Field of Search ..... 72/97, 96, 209, 477, 72/481

[56] References Cited

UNITED STATES PATENTS

| | | | |
|---|---|---|---|
| 792,231 | 6/1905 | Nicholson | 72/97 |
| 2,778,253 | 1/1957 | Brownstein | 72/209 |
| 3,762,201 | 10/1973 | Schonfeld et al. | 72/209 |

*Primary Examiner*—Milton S. Mehr

*Attorney, Agent, or Firm*—Webb, Burden, Robinson & Webb

[57] ABSTRACT

The rolling mill plug assembly comprises a guide plug and a working plug joined together in interlocking relationship. The working plug includes a female connection formed by a socket recess in one end. Two opposing flanges extend over the recess and are spaced apart by a central opening and opposing slots in registry with the recess. The guide plug includes a male connection comprised of a neck extending outward from one end of the guide plug which terminates in two opposingly extending lugs which are adapted to pass through the slots and into the recess in the working plug. Rotating the guide plug positions the lugs under the flanges and locks the guide plug in place within the recess of the working plug. A key assembly can be employed with the two plugs to maintain them in interlocking relationship.

8 Claims, 10 Drawing Figures

ROLLING MILL PLUG ASSEMBLY

FIELD OF THE INVENTION

My invention relates to plug rolling mills and more particularly to the actual rolling mill plugs used in the production of seamless pipe from pierced shells.

DESCRIPTION OF THE PRIOR ART

Plug rolling mills are used to transform a pierced shell into a seamless pipe. Normally the pierced shell is reheated after the piercing operation and is placed on a delivery trough at the entry end of the rolling mill. An alloy steel mandrel or plug is attached to the end of a support bar which holds the plug in a correct position in the roll groove. The plug is generally larger in diameter than the support bar in order to provide clearance between the inside of the tube and the support bar. The shell is started over the plug by means of a ram or pusher to permit the rolls to secure a good bite on the shell. Once started, the frictional forces due to the revolving rolls are sufficient to draw the shell rapidly over the plug slightly reducing its diameter in wall thickness and increasing its length. The operation includes two passes through the mill with the second pass being made over a second plug after the tube is rotated through an angle of 90°.

The rolling mill plugs used heretofore have been made of two separate plugs positioned along a common shaft and separated by springs, washers, bushings and the like. An entry cone is positioned at the forward end of the shaft. The first plug acts as a guide to center the shell and the second plug provides the working surface to establish the internal diameter of the seamless pipe. These prior art rolling mill plug assemblies require time and effort to assemble. In addition, the shear number of parts involved renders the assemblies prome to malfunction through incorrect assembly or when defects occur in any one of the components.

SUMMARY OF THE INVENTION

My invention eliminates many of the heretofore mentioned component parts of the plug assembly and results in a simplified two piece plug assembly that accomplishes the same end result with a minimum number of parts and labor. In turn this results in cumulative time savings during the plug assembly operation so as to increase the production and efficiency. The parts are easily interchangeable and can be replaced with ease after they become worn and rendered useless.

My plug assembly includes a guide plug and a working plug joined together in interlocking relationship. The working plug includes a female connection having a recess extending into the working plug main body. The recess is further defined by two opposing flanges extending over the recess and spaced apart by a central opening and opposing slots in registry with said recess. The guide plug includes a main body terminating in a neck of reduced cross section which in turn terminates in two opposingly extending lugs which are adapted to pass through the slots into the recess so as to form the interlocking connection when the guide plug is rotated relative to the working plug. The assembly may be further maintained in interlocking relationship through key means associated with the plugs.

DESCRIPTION OF THE PREFERRED EMBODIMENT

Figure 1:
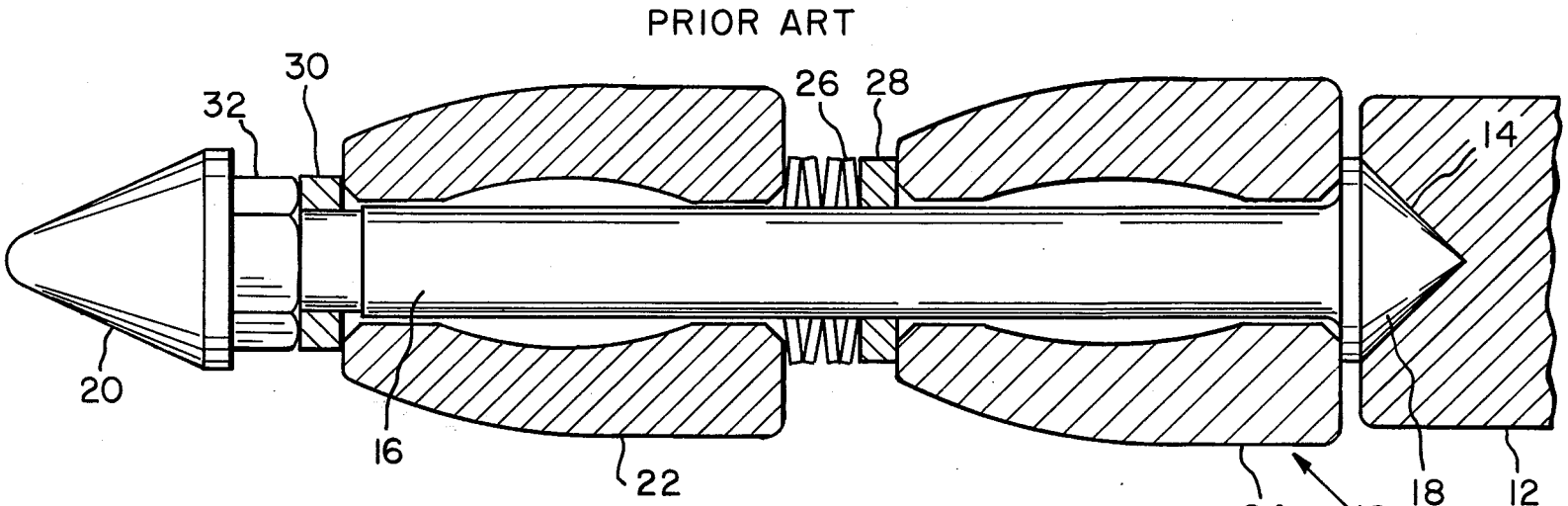
FIG. 1 illustrates a prior art rolling mill plug assembly.

The prior art rolling mill plug assembly is illustrated in FIG. 1. The assembly, generally designated 10, is assembled along a shaft 16 which terminates in an enlarged conical section 18 which is positioned in a mating conical recess 14 in the support bar, also termed the mandrel bar cap 12. The working plug 24 which is of the desired diameter to form the internal diameter of the seamless pipe (not shown) is positioned on the shaft 16 in abutment with the enlarged conical section 18. A first washer 28 is placed over the shaft 16 adjacent the working plug 24 and a disc spring 26 is positioned against the washer 28 on the shaft 16. Thereafter, the guide plug 22 is positioned against the disc spring 26 and is held in place by a second washer 30, a lock nut 32 and an entry cone 20 which is threaded at the end of shaft 16. Both the guide plug 22 and the working plug 24 are substantially frustodome shaped to facilitate the passing of the pierced shell thereover.

Figure 2:
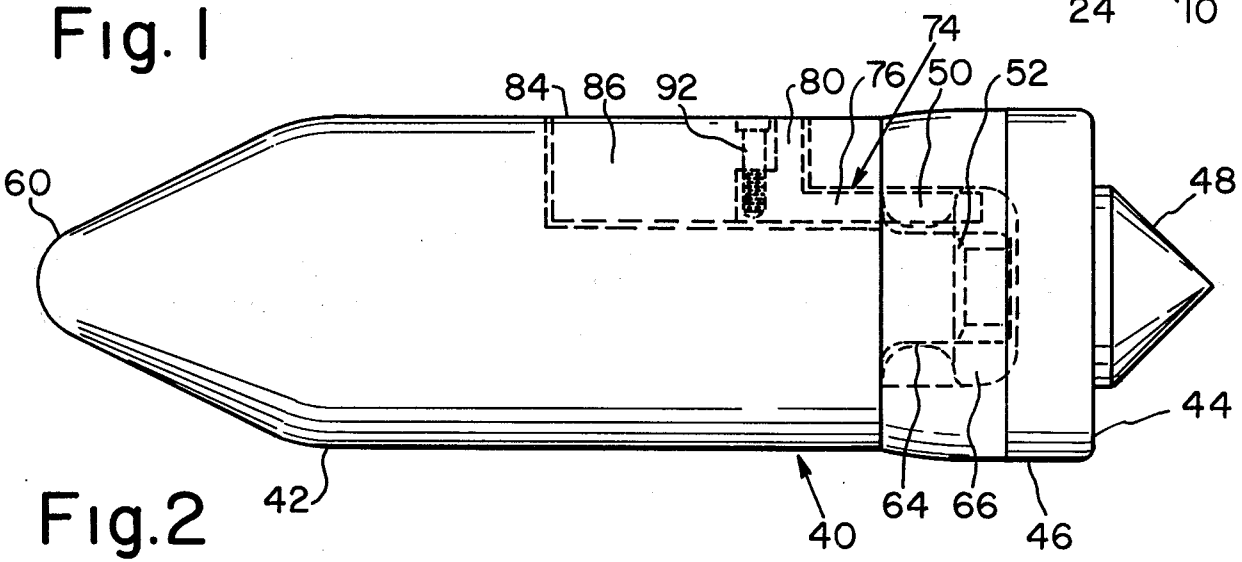
FIG. 2 is an elevation of my rolling mill plug assembly.
Figure 3:
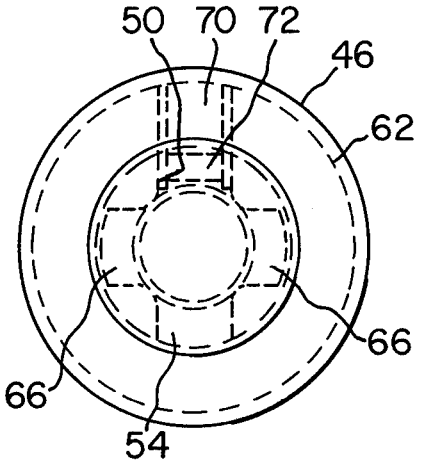
FIG. 3 is a bottom view of my rolling mill plug assembly.

My plug assembly, generally designated 40, comprises two main components namely guide plug 42 and working plug 44, joined in interlocking relationship, FIGS. 2 and 3. The guide plug 42 and the working plug 44, are maintained in interlocking relationship by a key 74 as will be described hereinafter.

Figure 4:
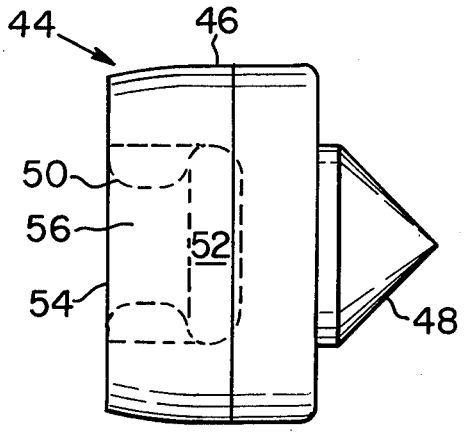
FIG. 4 is an elevation of the working plug.
Figure 5:
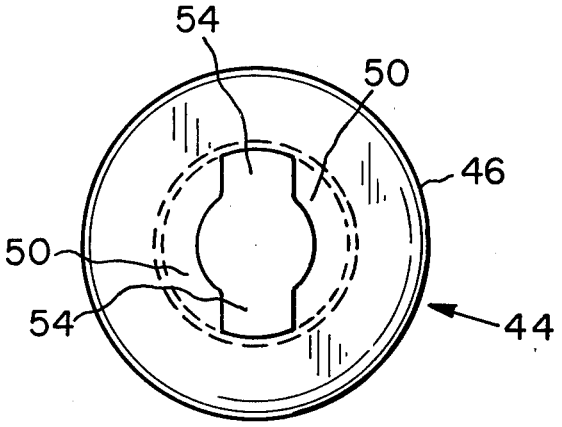
FIG. 5 is a plan view of the working plug.

The working plug 44 includes a main plug section 46 with an appropriately ground diameter to effect the reduction of the wall thickness and elongate the pierced shell to form the seamless pipe of the desired dimension, FIGS. 4 and 5. Main plug section 46 terminates in a conical section 48 which is used to center the working plug 44 on the mandrel bar cap (not shown) as in the prior art. A cored, socket type recess 52 extends into the other end of the main plug section 46. Herein after, the term socket recess is used to define this female portion of the connection. The socket recess 52 is further defined by two similarly dimensioned flanges 50 which extend over the socket recess 52. The flanges 50 are spaced from one another by slots 54 extending outward on opposing diametral ends of a central circular opening 56. The two slots 54 and central opening 56 are in registry with the socket recess 52 which extends underneath the respective flanges 50.

Figure 6:
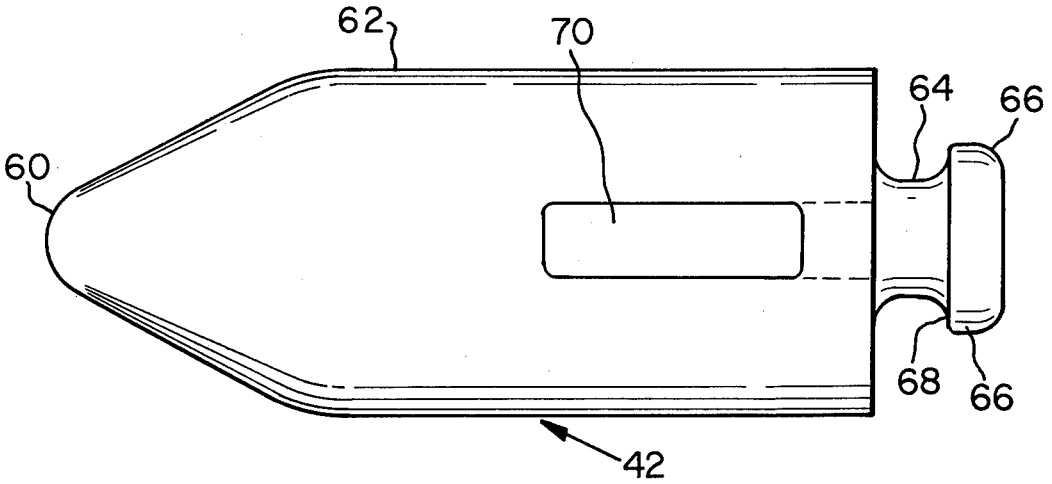
FIG. 6 is an elevation of the guide plug.
Figure 7:
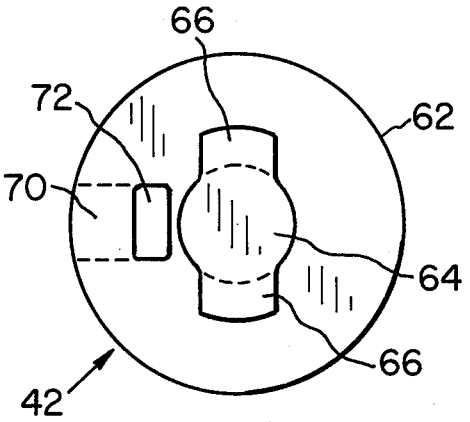
FIG. 7 is a bottom view of the guide plug.

A guide plug 42 comprises a main guide section 62 which terminates at its forward end in an entry section 60 which is substantially cone shaped and of sufficient axial extent to guide the pierced shell onto the main guide section 62, FIGS. 6 and 7. Integrally cast with the main guide section 62 is a neck 64 which is substantially cylindrical and which extends outward from the rearward end of the main guide section 62 along the centerline thereof. Neck 64 terminates in two lugs 66 which extend outwardly in opposing directions from each other and at right angles to the neck 64.

The lugs 66 are substantially flat along their respective surfaces which join to the neck 64 so as to form shoulders 68 which blend into neck 64 through appropriate casting fillets, FIG. 6. The lugs 66 are dimensioned so as to pass through the slots 54 and the neck 64 is dimensioned to pass through the opening 56 of the working plug 44. The axial extent of the neck 64 permits the lugs 66 to pass under the flanges 50 so that upon rotation of the guide plug 42 the shoulders 68 engage the bottom of the flanges 50 to define a male-female interlocking relationship, FIGS. 2 and 3.

A partially open slot 70 extends along the longitudinal axis of a portion of the main guide section 62 of the guide plug 42, FIGS. 6 and 7. Slot 70 is termed partially open in that it is only exposed along a portion of its length with the unexposed portion of the slot 70 being entirely internal of the main guide section 62. Slot 70 terminates at the end of the main guide section 62 in a slot opening 72 which is positioned substantially adjacent the neck 64, FIG. 7.

Figure 8:
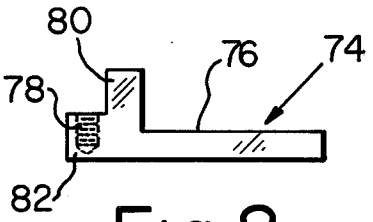
FIG. 8 is an elevation of the key.
Figure 9:
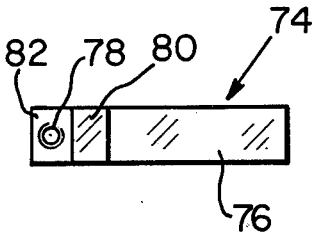
FIG. 9 is a side elevation of the key.

A key is utilized to maintain the guide plug 42 and the working plug 44 in assembled interlocking relationship, FIGS. 2 and 3. Specifically, the key 74 includes an elongated rectangular shank 76 at one end and an enlarged section 82 at the other end, FIGS. 8 and 9. Intermittent the enlarged section 82 and the shank 76 is an outwardly extending ledge 80. Enlarged section 82 includes a threaded tap 78 opened in the direction of ledge 80. The key 74 is dimensioned so that the elongated shank 76 extends through the slot 70 and out of the slot opening 72. The key shank 76 extends a sufficient distance out of slot opening 72 so as to extend into the socket recess 52. The key 76 is inserted after the aforementioned rotation of the guide plug 42 in the working plug 44. In this interlocked position, the key shank 76 is positioned in the slot 54 of the working plug 44 and is thereby prevented from rotating by flanges 50 which act as a stop.

Figure 10:
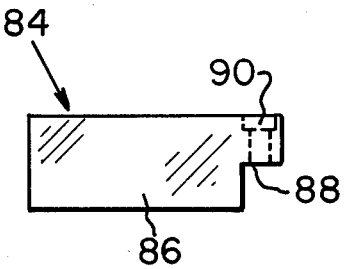
FIG. 10 is an elevation of the filler block.

The exposed portion of slot 70 is filled by a filler block 84, FIG. 2, which has a filler section 86 and a stepped connecting section 88 through which passes a counter sunk tap 90, FIG. 10. When the filler block 84 is inserted in the exposed portion of slot 70 the counter sunk tap 90 aligns with the threaded tap 78 in the key 74. The filler block 84 and the key 74 are joined together by means of an Allen cap screw 92. Tap screw 92 retains the filler block 84 and the key 74 in assembled relationship and the shank 76 of the key which passes through the unexposed portion of the slot 70 and the ledge 80 retain the filler block 84 and key 74 within the guide plug 42. The filler block 84 is dimensioned so as to form a continuous outer surface with the main guide section 62 of the guide plug 42.

The guide plug 42 and the working plug 44 are easily assembled by merely inserting the lugs 66 into the slots 54 and turning the guide plug 42 90° so that the lug shoulders 68 are positioned under the flanges 50 of the working plug 44. Thereafter, the key 74 is positioned in the slot 70 as described heretofore and the filler block 84 is screwed to the key 74 as previously described to complete the assembly. It will be understood that various other forms of keys can be employed to maintain the guide plug and the working plug in interlocking relationship where such a lock is deemed essential. It will also be recognized that once the working plug or the guide plug has become worn and rendered useless, it can be readily removed and replaced with a new one. By merely maintaining an inventory of the necessary incremental plug sizes which correspond to the wide range of seamless pipe sizes, the assembly operation can be carried out with a minimum of labor and changes in plug sizes can readily be made.

Having described a preferred embodiment of my invention, it may be otherwise embodied within the scope of the appended claims.

I claim:

1. A rolling mull plug assembly comprising a guide plug and a working plug, said working plug including female connecting means and said guide plug including male connecting means for interlocking relationship with said female connecting means, said assembly including locking means associated with the male and female connecting means to maintain said connecting means in interlocking relationship.

2. A rolling mill plug assembly comprising a guide plug and a working plug, said working plug including a main body section having a working surface and a female connecting means including a socket recess extending into the main body section, said socket recess defined by two opposing flanges extending over said socket recess and spaced apart by a central opening and opposing slots in registry with said recess, said guide plug including male connecting means for interlocking relationship with said female connecting means.

3. A rolling mill plug assembly comprising a guide plug and a working plug, said guide plug comprising a main body section terminating in a conical entry section at one end and including a male connecting means at another end comprising a neck extending from the main body and terminating in two lugs opposingly extending outward from the neck and normal thereto, said working plug including female connecting means for interlocking relationship with said male connecting means.

4. A rolling mill plug assembly comprising an interlocked guide plug and a working plug said working plug comprising a main body section having a working surface, a conical section extending outward from one end of the main body section, and a socket recess extending into the main body section from another end, said socket recess defined by two opposing flanges extending over said recess and spaced apart by a central opening and oppositely extending slots in registry with said recess, said guide plug including a main body section terminating in a conical entry section at one end and a neck at another end, said neck terminating in two oppositely extending lugs, said lugs adapted to pass through said slots into the socket recess so as to form an interlocking male-female connection when the guide plug is rotated to position the lugs beneath the flanges.

5. The assembly of claim 4 including a key assembly extending between the guide plug and the working plug to maintain said plugs in interlocking engagement.

6. The assembly of claim 5, said guide plug including a partially open slot extending along a portion of the main body and terminating in an opening adjacent the neck, said key assembly including an elongated key adapted for positioning in the guide plug slot so as to extend through the opening and one of the working plug slots and terminate within the recess adjacent the flanges to prevent rotation of the guide plug relative to the working plug.

7. The assembly of claim 6, said key assembly including a filler member positioned in the partially open slot and joined to the key so as to close off the slot and form a substantially continuous main body section.

8. The assembly of claim 6, said filler member joined to the key by a threaded fastener.

* * * * *

Disclaimer 4,015,460.—*Harry M. Moore, Jr.*, Beaver Falls, Pa. ROLLING MILL PLUG ASSEMBLY. Patent dated Apr. 5, 1977. Disclaimer filed Jan. 16, 1978, by the assignee, *Damascus Steel Casting Company*.

Hereby enters this disclaimer to claims 2, 3 and 4 of said patent.

[*Official Gazette March 21, 1978.*]